US005117078A

United States Patent [19]

Beckett

[11] Patent Number: 5,117,078

[45] Date of Patent: May 26, 1992

[54] CONTROLLED HEATING OF FOODSTUFFS BY MICROWAVE ENERGY

[75] Inventor: D. Gregory Beckett, Oakville, Canada

[73] Assignee: Beckett Industries Inc., Oakville, Canada

[21] Appl. No.: 650,246

[22] Filed: Feb. 4, 1991

Related U.S. Application Data

[63] Continuation-in-part of Ser. No. 535,168, Jun. 8, 1990, abandoned, which is a continuation-in-part of Ser. No. 475,326, Feb. 5, 1990, abandoned.

[30] Foreign Application Priority Data

Feb. 2, 1990 [CA] Canada ..... 2009207

[51] Int. Cl.[5] ..... H05B 6/80

[52] U.S. Cl. ..... 219/10.55 E; 219/10.55 F; 426/107; 426/243; 426/234; 99/DIG. 14

[58] Field of Search ..... 219/10.55 E, 10.55 F, 219/10.55 R, 10.55 D; 426/107, 234, 241, 243; 99/451, DIG. 14; 126/390

[56] References Cited

U.S. PATENT DOCUMENTS

| | | | |
|---|---|---|---|
| 3,219,460 | 11/1965 | Brown | 219/10.55 E |
| 3,302,632 | 2/1967 | Fichtner | 219/10.55 E |
| 3,615,713 | 10/1971 | Stevenson | 99/171 II |
| 3,845,266 | 10/1974 | Derby | 219/10.55 |
| 3,857,009 | 12/1974 | MacMaster et al. | 219/10.55 |
| 3,985,992 | 10/1976 | Goltsos | 219/10.55 E |
| 4,013,798 | 3/1977 | Goltsos | 426/107 |
| 4,081,646 | 3/1978 | Goltsos | 219/10.55 E |
| 4,144,438 | 3/1979 | Gelman et al. | 219/10.55 E |
| 4,190,757 | 2/1980 | Turpin et al. | 219/10.55 E |
| 4,196,331 | 4/1980 | Leveckis et al. | 219/10.55 E |
| 4,204,105 | 5/1980 | Leveckis et al. | 219/10.55 E |
| 4,230,924 | 10/1980 | Brastad et al. | 219/10.55 E |
| 4,268,738 | 5/1981 | Flautt, Jr. et al. | 219/10.55 E |
| 4,283,427 | 8/1981 | Winters et al. | 426/107 |
| 4,398,994 | 8/1983 | Beckett | 156/659.1 |
| 4,552,614 | 11/1985 | Beckett | 156/640 |
| 4,641,005 | 2/1987 | Seiferth | 219/10.55 E |
| 4,656,325 | 4/1987 | Keefer | 219/10.55 E |
| 4,676,857 | 6/1987 | Scharr et al. | 219/10.55 E |
| 4,735,513 | 4/1988 | Watkins et al. | 383/116 |
| 4,835,352 | 5/1989 | Sasaki et al. | 219/10.55 E |
| 4,866,234 | 9/1989 | Keefer | 219/10.55 E |
| 4,883,936 | 11/1989 | Maynard et al. | 219/10.55 E |
| 4,896,009 | 1/1990 | Pawlowski | 219/10.55 E |
| 4,927,991 | 5/1990 | Wendt et al. | 219/10.55 E |
| 4,948,932 | 8/1990 | Clough | 219/10.55 E |

FOREIGN PATENT DOCUMENTS

| | | |
|---|---|---|
| 0049551 | 4/1982 | European Pat. Off. . |
| 0091779 | 10/1983 | European Pat. Off. . |
| 0348156 | 12/1989 | European Pat. Off. . |
| 0350249 | 1/1990 | European Pat. Off. . |
| 0365247 | 4/1990 | European Pat. Off. . |
| PCT/US89/-00801 | 2/1989 | PCT Int'l Appl. . |

*Primary Examiner*—Philip H. Leung
*Attorney, Agent, or Firm*—Sim & McBurney

[57] ABSTRACT

A novel structure for use in the microwave cooking of foodstuffs for consumption is described. The structure includes a layer of flexible electroconductive material normally opaque to microwave radiation and having a plurality of elongate apertures therethrough dimensioned to permit microwave energy to pass through to the interior of the foodstuff and to produce thermal energy at the surface of the foodstuff. Both a microwave shielding effect and a combined microwave energy heating and thermal energy heating effect are obtained, enabling close control of the manner and extent of microwave cooking of the foodstuff to be obtained. The layer of flexible electroconductive material is supported by and adhered to a substrate layer of microwave energy transparent material in a multiple layer article of manufacture adapted to be formed into a packaging structure in which a foodstuff may be heated by microwave energy to an edible condition.

33 Claims, 6 Drawing Sheets

CONTROLLED HEATING OF FOODSTUFFS BY MICROWAVE ENERGY

REFERENCE TO RELATED APPLICATIONS

This application is a continuation-in-part of copending U.S. patent application Ser. No. 535,168 filed Jun 8, 1990 (now abandoned), which itself is a continuation-in-part of copending U.S. patent application Ser. No. 475,326 filed Feb. 5, 1990 (now abandoned).

BACKGROUND TO THE INVENTION

The use of microwave energy to cook a variety of foodstuffs to an edible condition is quick and convenient. However, some foodstuffs require crispening or browning to be acceptable for consumption, which is not possible with conventional microwave cooking.

It is known from U.S. Pat. No. 4,641,005 (Seiferth), assigned to James River Corporation, that it is possible to generate thermal energy from a thin metallic film (microwave susceptor) upon exposure thereof to microwave radiation and this effect has been used in a variety of packaging structures to achieve cooking of foodstuffs with microwave energy, including achieving crispening and browning, for example, of pizza crust.

Some food products which are to be cooked by microwave energy are in the form of an outer pastry dough shell and an inner filling. An example is an apple turnover. One problem which has arisen when packages employing thin metal films to generate thermal energy to obtain crispening and browning of such products, is that there is a considerable moisture loss from the filling and sometime a spilling of filling as the shell splits open, leading t an unsatisfactory product.

In addition, certain foodstuffs are difficult to brown and crispen satisfactorily. For example, while it is possible to improve the cooking of pot pies when compared to conventional oven-cooked pot pies, by the employment of microwave energy and multiple thin films of electroconductive material in the bottom of the dish, as described in my copending U.S. patent application Ser. No. 442,153 filed Nov. 28, 1989 ("Pot Pie Dish"), the disclosure of which is incorporated herein by reference, nevertheless the resulting product does not exhibit an ideal degree of browning.

Attempts have been made to improve the overall uniformity of heating which results when thin metal film microwave susceptors are exposed to microwave radiation. One such proposal is contained in U.S. Pat. No. 4,927,991 (Wendt), assigned to The Pillsbury Company, which describes the employment of a microwave-reflective grid in combination with a thin metal film microwave susceptor. The structure is stated to achieve a more uniformly heated foodstuff by controlling surface heating and microwave transmittance.

Another approach to the microwave cooking of foodstuffs is described in U.S. Pat. No. 3,845,266 (Derby), assigned to Raytheon Company. This patent describes a utensil for microwave cooking, which is intended to be reusable in a microwave oven and is illustrated, in one embodiment, as taking the form of a slotted rigid stainless steel plate. The slotted nature of the stainless steel plate is said to achieve browning and searing of foodstuff in contact with it in a microwave oven. The stainless steel plate sits on a member of microwave transparent material, such as glass, in the cavity of a microwave oven to effect such heating.

It also has been previously suggested from U.S. Pat. No. 4,230,924 (Brastad et al) to provide microwave energy generated browning of a foodstuff from a food package which includes a flexible wrapping sheet of polymeric film having a flexible metal coating, which either may be relatively thin film or relatively thick foil and which, in either case, is subdivided into a number of individual metallic islands in the form of squares. It has been found that, while some thermal energy generation is achieved by such structures, both with the relatively thin film and the relatively thick foil, little or no shielding of microwave energy is achieved using the described relatively thick foil structure. In this latter prior art, the metal is provided in the form of discrete islands which are separated one from another, and hence the metallized portion of the substrate is discontinuous in character.

Further, there have been a variety of proposals to moderate the proportion of incident microwave energy reaching a foodstuff by using perforated aluminum foil. For example, U.S. Pat. Nos. 4,144,438, 4,196,331, 4,204,105 and 4,268,738, all assigned to The Procter & Gamble Company, disclose a microwave cooking bag formed from a laminate of two outer thermoplastic films sandwiching a perforated aluminum foil having a series of large circular apertures therethrough. While this arrangement may be useful in moderating the microwave energy entering the foodstuff, these openings are not of a size or shape which permits the generation of thermal energy, so that no surface browning can result.

Similarly, U.S. Pat. Nos. 3,219,460 (Brown), 3,615,713 (Stevenson), 3,985,992, 4,013,798 and 4,081,646 (Goltsos) describe T.V. dinner trays intended for use for microwave cooking of such foods, in which the lid is provided with apertures of varying dimension through microwave opaque materials incorporated into the lid structure to control the flow of microwave energy to the different food products in the tray. Again, the apertures are not of a size or shape to permit the generation of thermal energy.

SUMMARY OF INVENTION

In the present invention, the manner of thermal energy generation described in the aforementioned U.S. Pat. No. 3,845,266 is utilized, but in a unique manner in an article of manufacture from which packaging structures may be formed. This arrangement enables me to overcome the prior art problems that I have referred to above in the microwave heating of a variety of foodstuffs, particularly those requiring crispening and browning.

It has now been found that flexible electroconductive materials, normally opaque to microwave energy, can be modified so that thermal energy can be generated from the flexible electroconductive material in a selected and controlled manner.

Such normally microwave-opaque electroconductive materials, for example, aluminum foil, have been commonly-used to achieve shielding of foodstuffs from microwave radiation during microwave cooking, but are not known as being capable of converting any portion of the incident microwave radiation to thermal energy, in contrast to the very thin electroconductive material layers described in U.S. Pat. No. 4,641,005 mentioned above.

I have found that, if a plurality of elongate apertures of appropriate dimensions is formed in the flexible electroconductive material, then thermal energy is generated in the region of the apertures upon exposure of the flexible electroconductive material to microwave radiation. For the generation of thermal energy, it is essential for each of the plurality of the apertures to be elongate and to be separate and discrete.

For the layer of flexible apertured electroconductive material to be usefully incorporated into a packaging structure, it is essential that the layer of flexible electroconductive material be supported on and be in adhered structural relationship with a substrate layer of microwave energy transparent material.

In accordance with the present invention, there is provided a multiple layer article of manufacture adapted to be formed into a packaging structure in which a foodstuff may be heated by microwave energy to an edible condition. By providing an article of manufacture which is able to be formed into a packaging structure, in accordance with the present invention, a food product may be maintained in the same structure through the multiple steps of filling, freezing, storing, shipping, retailing and then microwave reconstitution for consumption, before discard.

The article of manufacture of the invention comprises a layer of flexible electroconductive material supported on a substrate layer. The layer of flexible electroconductive material has a thickness which is normally substantially opaque to microwave radiation and has a plurality of elongate apertures extending wholly through the thickness of the electroconductive material layer and effective to generate thermal energy in the plurality of apertures when the article of manufacture is exposed to microwave energy and the foodstuff is in contact with or proximate to the plurality of apertures.

The plurality of apertures is sized and arranged in the layer of flexible electroconductive material to generate sufficient thermal energy to effect a desired surface browning of the foodstuff while permitting sufficient microwave energy to penetrate the layer of flexible electroconductive material through the plurality of apertures into the foodstuff to effect a desired degree of dielectric heating of the foodstuff, whereby the foodstuff may be provided in an edible condition.

The substrate layer is formed of microwave energy transparent material and is in adhered structural supporting relationship with the flexible layer of electroconductive material so that a packaging structure may be formed from the article in which the foodstuff may be positioned.

The multiple layer article of manufacture of this invention, while superficially similar to the structure disclosed in aforementioned U.S. Pat. No. 3,845,266 (Derby), in that both employ a slotted structure to generate thermal energy from microwave radiation in the cooking of foodstuffs. However, significantly structural differences exist:

(a) The article described in '266 is a utensil for a microwave oven in the form of a slotted rigid stainless steel plate, whereas the article with which the present invention is concerned is suitable for formation of packaging material for foodstuffs, which enables the advantage of employing the same structure for the foodstuff through its multiple stages of processing from filling of the packaging structure to microwave reconstitution of the foodstuff to be realized. The structure shown in '266 is not capable of utilization or adoption as a packaging structure and is employed solely during microwave reconstitution of the foodstuff;

(b) In the present invention, the layer of apertured electroconductive material is a flexible material, such as aluminum foil, whereas the element that produces thermal energy in '266 is described as load supporting and hence must be capable of supporting the load of the foodstuff to be heated. As noted above, the element takes the form of a rigid stainless steel plate. The flexible electroconductive material layer used in the present invention is not itself load supporting, in the sense the term is used in '266;

(c) In the present invention, the flexible electroconductive material layer is supported on and adhered to a substrate layer of microwave transparent material. By providing this multiple-layer structure, packaging structures may be provided in which the foodstuff may be packaged from filling to consumption. It should be noted that the article resulting from the combination of the flexible electroconductive material layer with the substrate layer may itself take a variety of physical forms, depending upon the packaging structures to be formed therefrom and the foodstuff to be packaged therein, including flexible, stiff or semi-stiff or rigid. The '266 patent discloses a second element, which is a member of microwave transparent material, which also is rigid and underlies the slotted stainless steel plate in the microwave oven cavity.

GENERAL DESCRIPTION OF INVENTION

Figure 1:
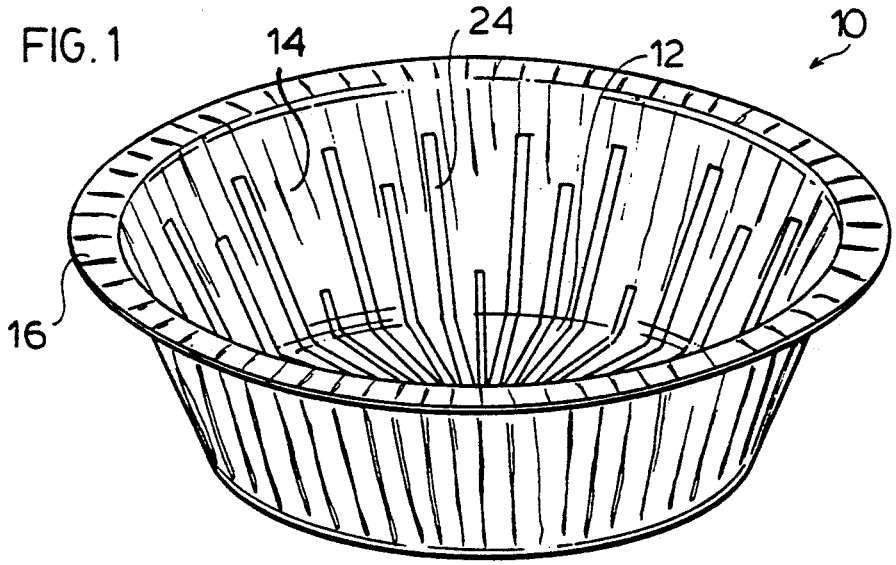
FIG. 1 is a perspective view of a pot pie dish provided in accordance with one embodiment of the invention.

It is generally known that electroconductive metals having a thickness above that at which a portion of the microwave radiation is converted into thermal energy become largely opaque to microwave radiation, such as aluminum of foil thickness, and this effect has been employed to achieve shielding of foodstuffs from microwave energy, in a variety of structures, such as is described above.

In the present invention, a plurality of elongate apertures is formed through the electroconductive metal layer. In this structure, the metal or other electroconductive material shields the foodstuff from the passage of microwave energy therethrough while microwave energy is permitted to pass through the elongate apertures into the foodstuff. At the same time, a portion of the microwave energy passes through the apertures, producing an intense field at the periphery and access the whole dimension of each aperture, which, in turn, causes surface browning of the food.

In this way, the intensity of microwave energy reaching the foodstuff filling is considerably decreased by the shielding effect of the metal, while permitting browning and crispening of the exterior, so as to produce a cooked food product with much decreased moisture loss.

The proportion of incident microwave energy passing through the apertures into the foodstuff may be increased by making the gap wider, while making the gap longer and narrower increases the intensity of the surface heating. By appropriate choice of individual aperture size and number of apertures, heating of the foodstuff by microwave energy is controllable to a considerable degree.

As noted above, several structures have been described which employ circulator or similarly geometrically-shaped openings in shielding structures. However, the different geometry of opening employed in the present invention produces a dramatically-different result, namely that the present invention enables thermal energy to be produced for surface browning and crispening while achieving shielding of the foodstuff from exposure to the full effect of the microwave energy.

This result enables a much greater degree of control to be achieved over the microwave cooking of food products which are comprised of component parts which require different degrees of cooking, and, in particular, those that require outer crispening or browning and yet may suffer from moisture loss, which may lead to some sogginess of the product, if overexposed to microwave energy. Examples of foodstuffs which may be cooked or reheated for consumption with advantage by microwave energy, using the structure of the present invention, are french fries, pot pies, pizzas, burritos and apple turnovers.

In the present invention, there is employed a layer of flexible electroconductive material which is of a thickness which is normally opaque to microwave energy, and which is supported by and adhered to a layer of microwave transparent material. The minimum thickness varies with the material chosen. Generally, the layer has a minimum thickness of about 1 micron. The flexible electroconductive material layer conveniently may be provided by aluminum foil having a thickness of about 1 to about 15 microns in thickness, preferably about 3 to about 10 microns, typically about 7 to about 8 microns. Other suitable electroconductive materials include stainless steel, copper and carbon.

The layer of electroconductive material is provided with a plurality of elongate thermal energy-generating apertures therethrough. The number, size and relative location of the elongate apertures depends on the size of the foodstuff and the degrees of internal cooking and of surface browning desired.

Each aperture is elongate and may comprise a single opening formed into a spiral or other pattern so as to have the physical appearance of a plurality of apertures. Each aperture of the plurality of apertures generally is no shorter than about 1.75 cm and may extend for any desirable length. An aperture generally varies in width from about 1 mm to about 2 cm, provided that the length is greater than the width. In general, more surface heating of the foodstuff is achieved as the apertures become longer and narrower. As the apertures become wider, more microwave energy is able to pass through into the interior of the foodstuff, so that less intense heat generation and less shielding of the microwave energy from penetration to the foodstuff result.

Where a plurality of individual apertures is employed or the plurality of apertures is provided by a single aperture arranged in a pattern, a metal spacing of at least about 0.5 mm is maintained between individual apertures or between portions of the same aperture.

Where a plurality of individual apertures is employed, the apertures may be equally dimensioned and equally spaced apart, which produces an even degree of heating over the expanse of the continuous layer of electroconductive material containing such plurality of apertures. However, the dimensions and spacing of individual ones or groups of the plurality of apertures may be varied and may be located only in selected portions of the expanse of the continuous layer of electroconductive material, so as to achieve differential degrees of heating, differential ratios of internal and surface heating and shielding only, as desired, in various locations of the expanse of the layer of electroconductive material. The number, location and size of the apertures may be such as to achieve any desirable combination of microwave energy reflected, transmitted and converted into thermal energy for the packaging structure, both in the overall structure and locally within the structure.

Another alternative which may be used, depending on the result which is desired, is to provide, in each aperture, an electroconductive material of sufficient thinness that a portion of microwave energy incident thereon is converted to thermal energy, as described in U.S. Pat. No. 4,641,005 (Seiferth), referred to above, so as to augment the browning effect which results from the aperture itself.

Using the guidlines above, it should be possible for a person skilled in the art to manipulate the apertures in the layer of flexible normally microwave-opaque electroconductive material to provide the required degree and type of heating for any given foodstuff to achieve the optimum cooked condition for consumption.

The elongate apertures may be formed in the continuous flexible electroconductive material layer in any convenient manner, depending on the nature of the electroconductive material and the physical form of the electroconductive material.

For example, with the electroconductive material being a self-supporting aluminum foil layer, the apertures may be stamped out using suitable stamping equipment, and then adhered to the substrate layer. Alternatively and more preferably, with the electroconductive material being aluminum foil or other etchable metal supported on a polymeric film, such as by laminating adhesive, the apertures may be formed by selective demetallization of metal from the polymeric film using, for example, the procedures described in U.S. Pat. Nos. 4,398,994 and 4,552,614, the disclosures of which is incorporated herein by reference, wherein an aqueous etchant is employed to remove aluminum from areas unprotected by a pattern of etchant-resistant material. Another possible procedure involves the use of ultrasonic sound to effect such selective demetallization.

Following such selective demetallization, a polymeric lacquer or other detackifying material may be applied over the exposed surfaces of laminating adhesive in the selectively demetallized electroconductive layer to inhibit adjacent layers from adhering to one another as a result of exposed adhesive in the apertures, when a web of such selectively demetallized material is rolled up, as is often the case prior to formation of the desired packaging material.

For the purpose of providing a packaging material, the apertured flexible electroconductive material layer is supported on and adhered to a continuous substrate of suitable microwave-transparent substrate, which generally is microwave-transparent stock material which does not deform upon the generation of heat from the layer of electroconductive material during exposure of a foodstuff in the packaging material to microwave energy.

The flexible layer of electroconductive material may conveniently be laminated to a paper or paperboard substrate as the stock material, which may be semi-stiff or stiff, with the packaging material being formed from the resulting laminate. Similarly, the layer of flexible electroconductive material may be laminated to a heat-resistant polymeric material substrate as the stock material to provide the article of manufacture. The layer of flexible electroconductive material also may be laminated between two outer paper or paperboard layers, or may be laminated between a heat resistant polymeric material layer, and a paper or paperboard layer. In these structures, the polymeric material layer, such as polyester or polyethylene, may be flexible or rigid.

Alternatively, the flexible layer of electroconductive material may be laminated to a single or between two rigid thermoformable polymeric material layer(s), by adhesive bonding, and the laminate may be thermoformed to the desired product shape.

The multiple layer article of manufacture of the present invention may be incorporated into a variety of packaging structures for housing foodstuffs where the generation of thermal energy during microwave heating is desired. The structures may include a variety of trays and dishes, such as disposable pot pie dishes and rigid reusable trays or dishes, a variety of bag structures, such as french fry bags and bags for cooking crusty filled products, for example, an apple turnover, a variety of box structures, such as pizza boxes, and domestic ware, such as reusable or disposable plates and dishes.

As noted above, one of the significant advantages of the structure of the present invention is the ability to employ the structure in manufacturing, retailing and consumption of the foodstuff packaged therein. The packaging structure generally conforms to the physical three-dimensional form of the foodstuff, whether in the form of relatively stiff or rigid dish or tray, or in the form of a flexible bag structure, to enable the desired microwave heating of the foodstuff to be achieved.

It may be desirable to provide a layer of release material on food-contacting surfaces of the structure, to inhibit sticking of food to such surfaces.

DESCRIPTION OF PREFERRED EMBODIMENTS

Figure 2:
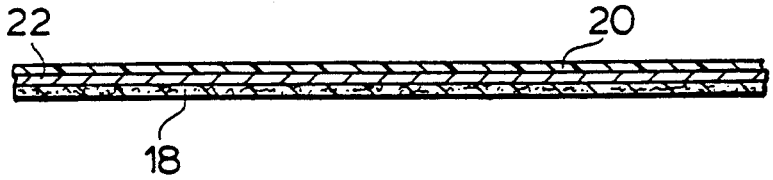
FIG. 2 is a sectional view of the pot pie dish of FIG. 1.
Figure 3:
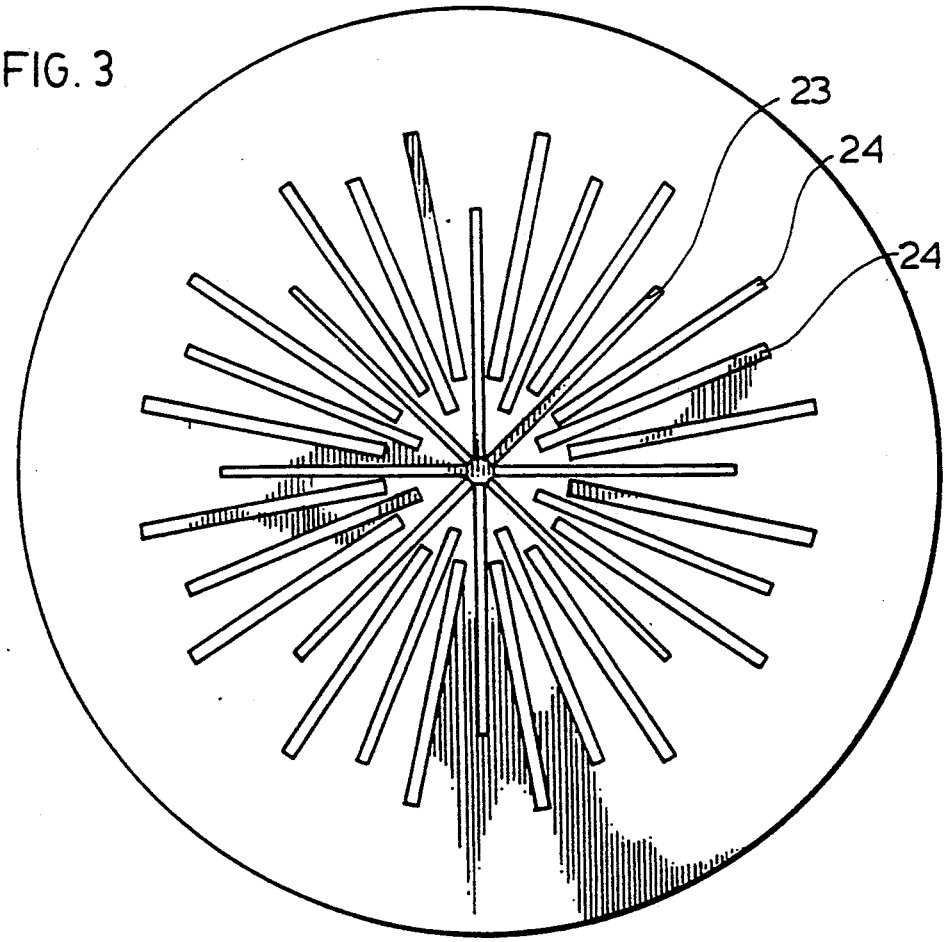
FIG. 3 is a plan view of a blank from which the pot pie dish of FIG. 1 is formed.

Referring first to FIGS. 1 to 3, there is shown therein a pot pie dish 10 constructed in accordance with one embodiment of the invention. (FIG. 3 shows the blank for the dish 10 prior to stamping or other suitable forming operation). As seen therein, the dish is of conventional shape, having a circular base 12, an upwardly and outwardly flared side wall 14 and an outwardly-extending lip 16.

The pot pie dish 10 is formed from a laminate of an outer layer 18 of paperboard of suitable thickness to provide structural support to the dish 10, an inner layer 20 of heat-resistant polymeric film and a layer 22 of aluminum foil or similar flexible microwave-opaque electroconductive material sandwiched therebetween.

The layer 22 of aluminum foil has a plurality of elongate narrow thermal energy-producing apertures 24 formed therethrough. The apertures 24 are provided in a star-like array in the aluminum foil layer, with arms radiating in a uniform pattern from the centre of the base 12 of the dish.

By arranging the apertures 24 in this way, it has been found that, when a pot pie is microwave cooked in the dish 10, the microwave energy 24 is channelled by the apertures 24 towards the center of the dish 10. Heat is generated along the length and width of each of the apertures 24 but the heat is more intense in the base 12 of the dish 10, resulting in improved browning of the crust on the bottom of the pot pie, in comparison to previously-proposed structures.

In addition, the presence of the microwave-opaque aluminum foil in the side wall 14 limits the proportion of the incident microwave energy which can pass through the side wall 14 into the contents of the pot pie dish.

By controlling the proportion of microwave energy entering the pot pie filling, the pot pie may be cooked by microwave energy for consumption and an adequate degree of browning both to the side wall and bottom of the pot pie achieved, without overcooking the pie filing and causing significant moisture loss.

Figure 4:
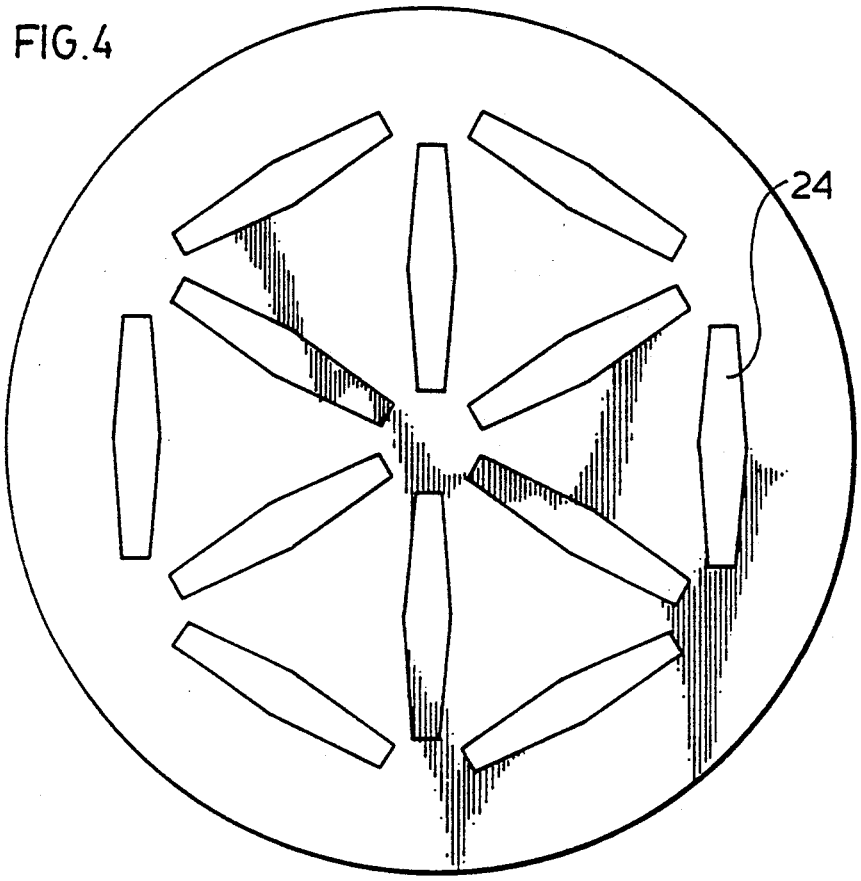
FIGS. 4 to 11 show alternative forms of the blank of FIG. 3.
Figure 5:
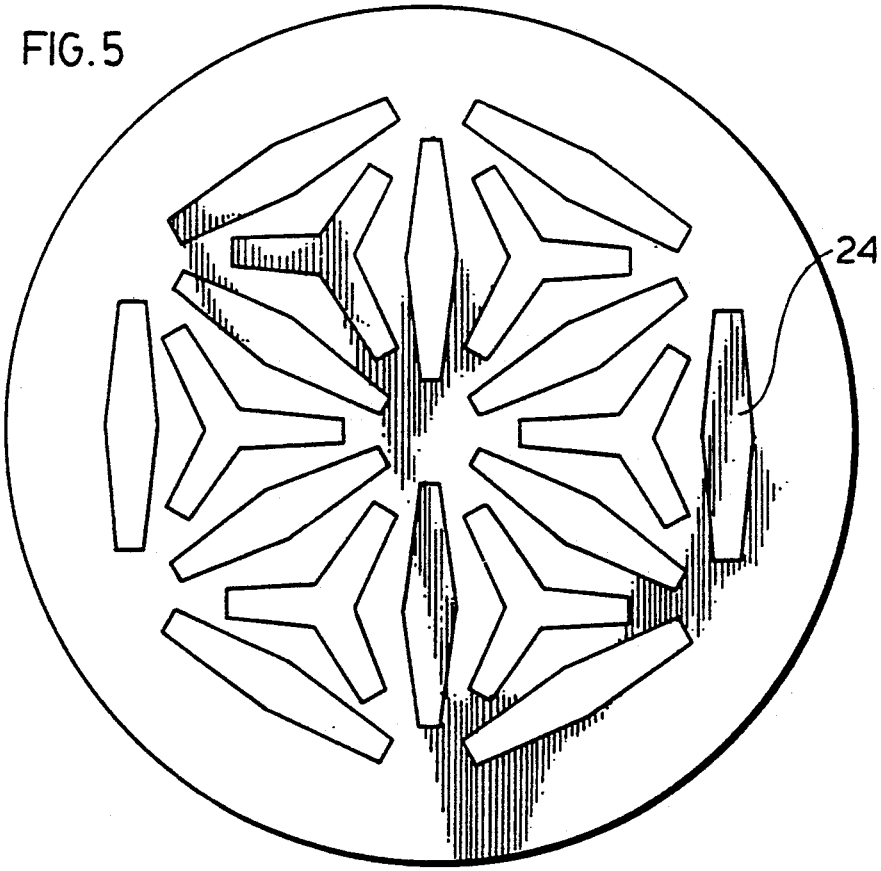
Figure 6:
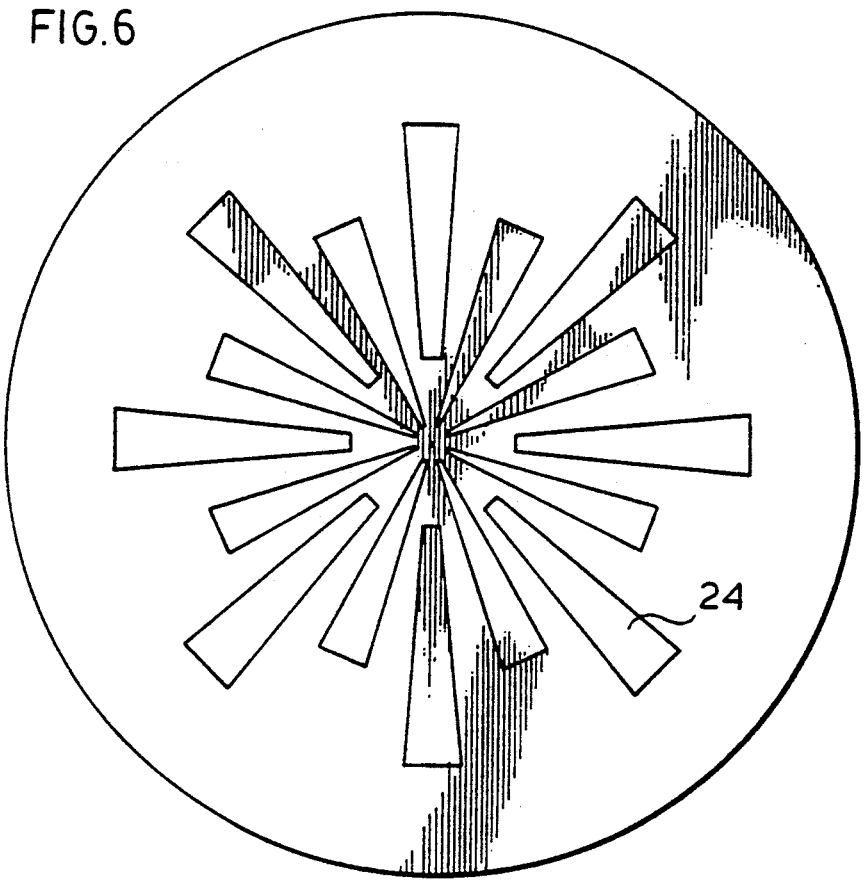
Figure 7:
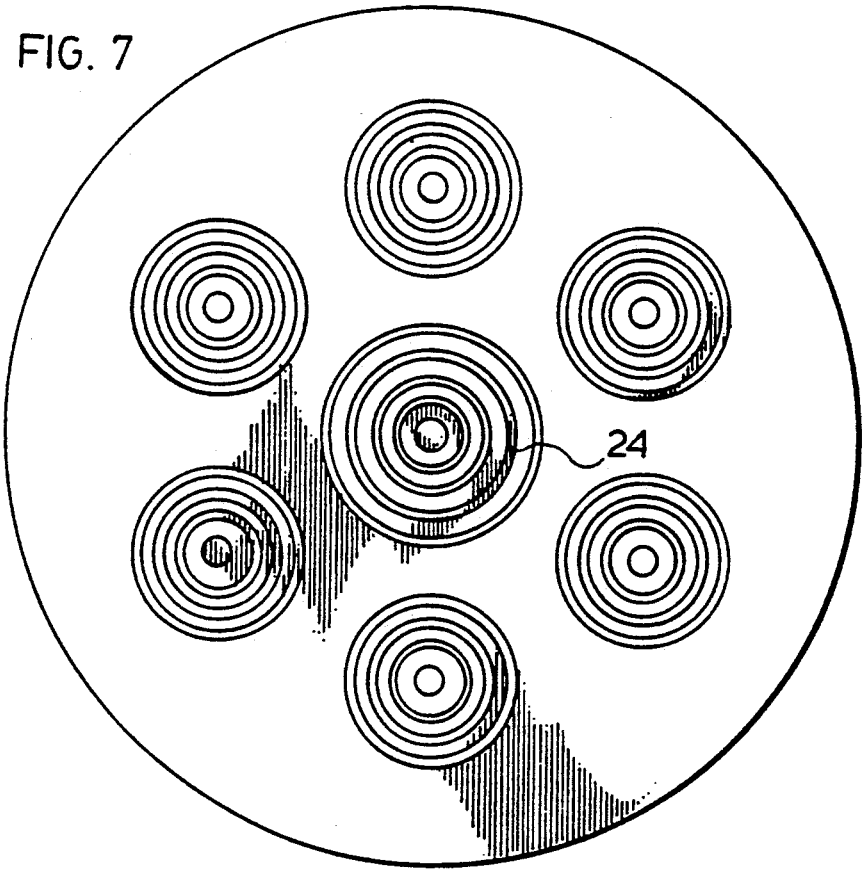
Figure 8:
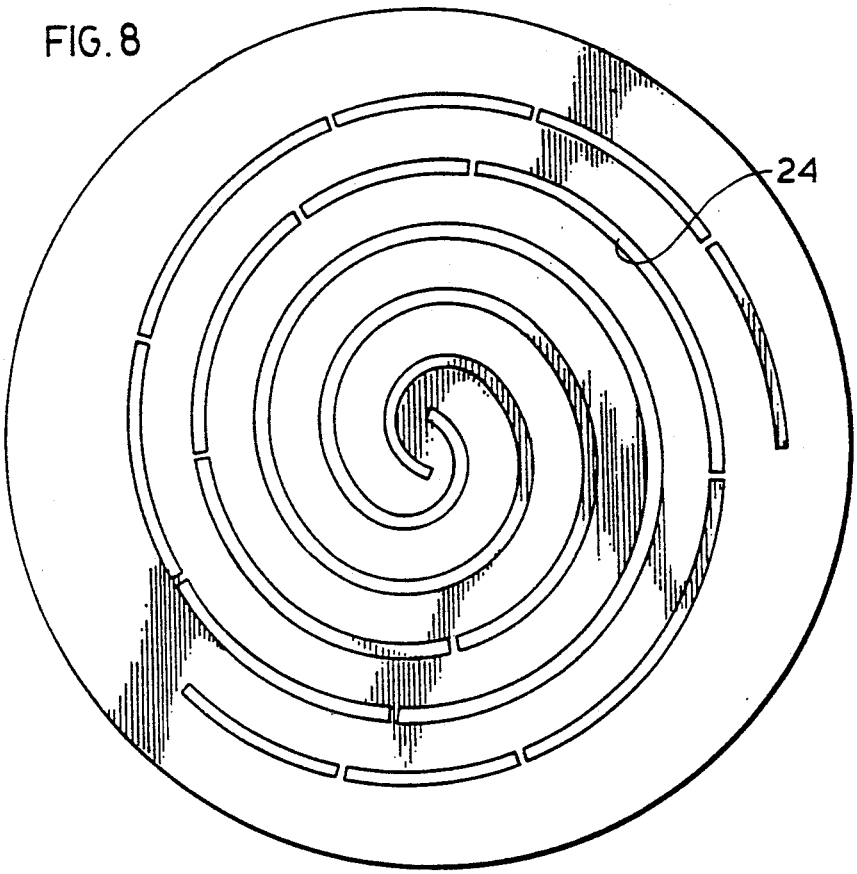

In FIGS. 1 to 3, the apertures 24 are rectangular in outline shape and are of the same width, although differing in length and having a significantly longer longitudinal dimension than transverse dimension. FIGS. 4, 5 and 6 illustrate alternative arrangements of apertures in a blank from which a pot pie dish may be formed by a suitable forming operation, in which the apertures are elongate and of regular geometric shape but not rectangular. In FIG. 7, the apertures 24 are formed as a plurality of series of concentric rings. In FIG. 8, the apertures 24 are formed in the shape of two discontinuous spirals.

Figure 9:
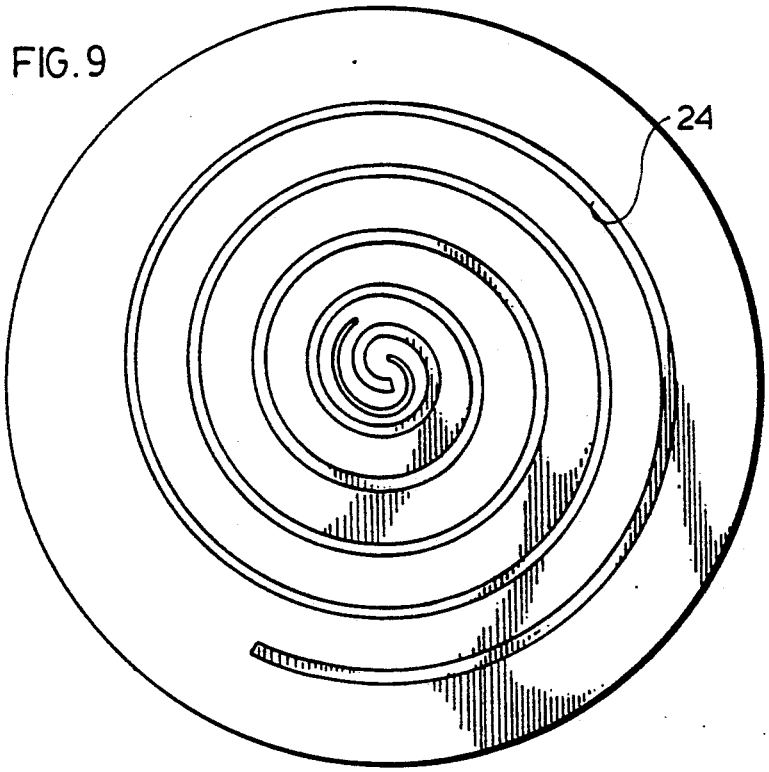
Figure 10:
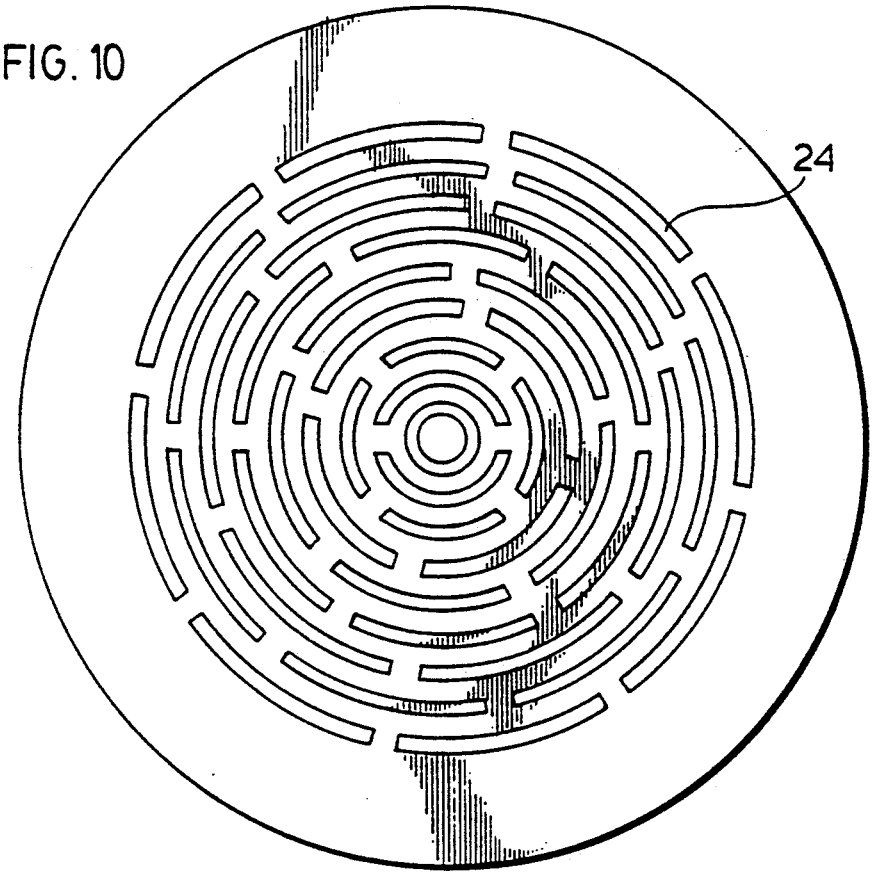
Figure 11:
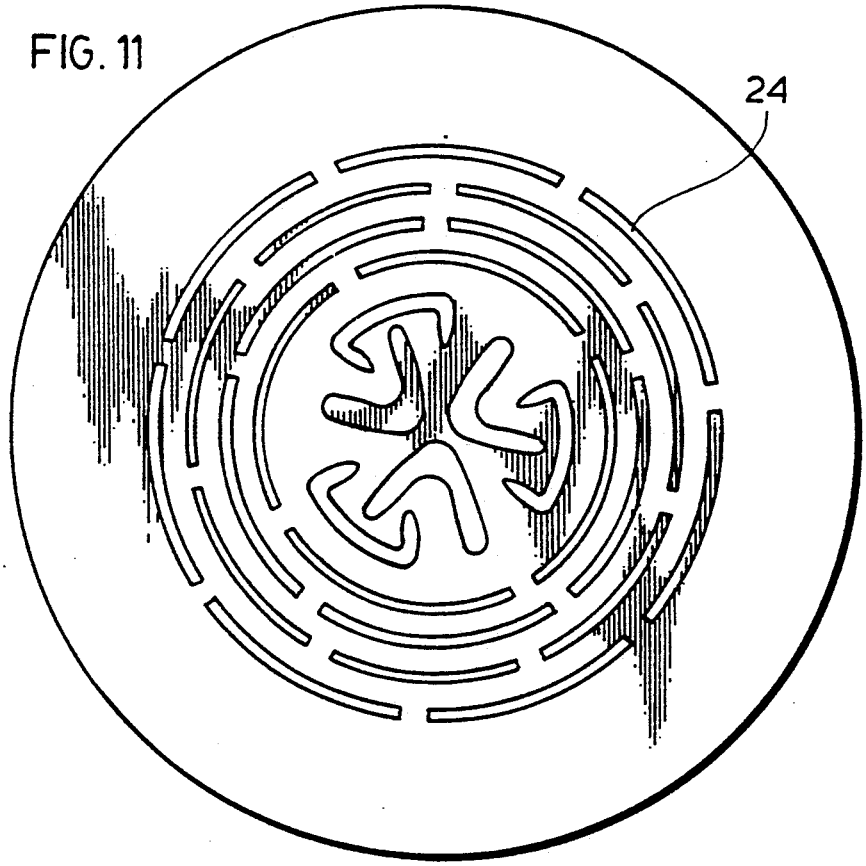

In FIG. 9, the aperture 24 takes the form of a single spiral, with an additional small counter-spiral formed near the center to enhance thermal energy generation at that location. FIGS. 10 and 11 illustrate further alternative structures for the arrangement of apertures.

Each of the arrangements of apertures shown in FIGS. 1 to 11 is useful for a microwave oven pot pie dish. The specific arrangement employed, or whichever alternative arrangement is employed, depends on the desired proportion of incident microwave energy to be converted into thermal energy, to be reflected by the microwave-opaque aluminum foil or to be permitted to pass through into the pie filling.

Figure 12:
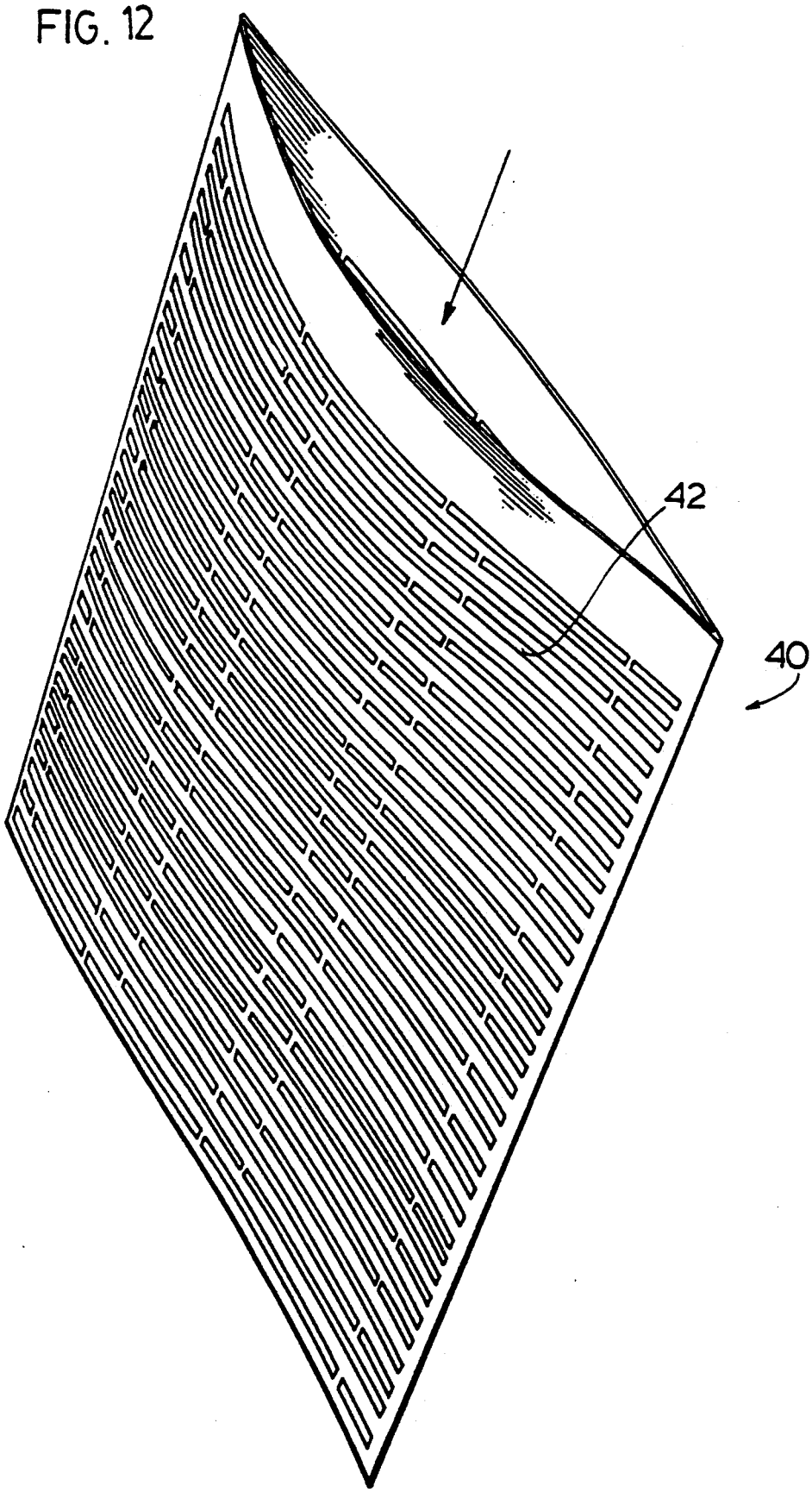
FIG. 12 is a perspective view of a microwave bag provided in accordance with an additional embodiment of the invention.

In FIG. 12, there is shown a bag structure 40 for heating a foodstuff by microwave energy, such as french fries or apple turnovers. In this case, the bag structure is formed of a laminate of outer and inner layers of paper and a layer of aluminum foil or similar flexible microwave-opaque electroconductive material sandwiched therebetween. A plurality of elongate thermal energy-generating apertures 42 is formed through the aluminum foil in a regular parallel array. In a modification of this structure, the laminate may comprise only one side of the bag structure.

With this arrangement, the desired outer crispening of the foodstuff by thermal energy produced in the apertures 42 may be achieved while the shielding effect of the remainder of the continuous aluminum foil layer slows down the heating of the interior of the foodstuff, decreasing moisture loss and avoiding boil-over. Various modifications to the numbers, geometry, dimensions and spacing of the apertures 42 may be effected, along the lines discussed above with respect to the pot pie dish structure of FIGS. 1 to 11, to achieve any desired microwave heating effect with respect to the foodstuff packaged in the bag structure.

EXAMPLES

EXAMPLE 1

A chicken pot pie was cooked for 6 minutes in a standard microwave oven packaged in a pot pie dish as illustrated in FIG. 1 and also as illustrated in my aforementioned copending U.S. patent application No. 442,153 ("Pot Pie Dish").

Both products were cooked ready for consumption. However, with the pot pie dish of FIG. 1, the moisture loss from the pie was around 14% while from the pie cooked using my prior invention moisture loss was around 26%, i.e. considerably less in the case of the present invention.

In addition, an examination of the exterior of the pot pie in the two cases showed improved browning in the base portion of the pot pie cooked using the pot pie dish of FIG. 1 when compared to the prior structure.

EXAMPLE 2

A vegetable pastry was cooked for 3½ minutes in a microwave oven in a bag structure as illustrated in FIG. 11 and in a bag structure as illustrated in my copending U.S. patent application Ser. No. 421,668 filed Oct. 16, 1989 ("Ele-Met Bag"), the disclosure of which is incorporated herein by reference. In both cases, the product was cooked, ready to eat and had a browned exterior. However, in the case of the bag of FIG. 11, the moisture loss was 14%, as compared with 26% for the prior structure, i.e. considerably less in the case of the present invention.

SUMMARY OF DISCLOSURE

In summary of this disclosure, the present invention provides a novel structure which is able to control the flow of microwave radiation to a foodstuff, so as to control the degree of cooking and the ratio of internal to external cooking. Modifications are possible within the scope of this invention.

What I claim is:

1. A multiple layer article of manufacture, adapted to be formed into a packaging structure in which a foodstuff may be heated by microwave energy to an edible condition, comprising:

a layer of flexible electroconductive material supported on a substrate layer, said layer of flexible electroconductive material having a thickness which is normally substantially opaque to microwave radiation and having a plurality of elongate apertures extending wholly through the thickness of said electroconductive material layer and effective to generate thermal energy in said plurality of apertures when said article is exposed to microwave energy and the foodstuff is in contact with or proximate to said plurality of apertures, said plurality of apertures being sized and arranged in said layer of flexible electroconductive material to generate sufficient thermal energy to effect a desired surface browning of the foodstuff while permitting sufficient microwave energy to penetrate said layer of flexible electroconductive material through said plurality of apertures into the foodstuff to effect a desired degree of heating of the foodstuff, whereby the foodstuff may be provided in an edible condition, and said substrate layer being formed of microwave energy transparent material and being in adhered structural supporting relationship with said flexible layer of electroconductive material so that a packaging structure may be formed from said article in which said foodstuff may be positioned.

2. The article of claim wherein said layer of flexible electroconductive material has a thickness of at least about 1 micron.

3. The article of claim 1 wherein said layer of electroconductive material is aluminum foil having a thickness of from about 1 to about 15 microns.

4. The article of claim 3 wherein said aluminum foil has a thickness of about 3 to about 10 microns.

5. The article of claim 3 wherein each said aperture has a width of at least about 1 mm and a length of at least about 1.75 cm.

6. The article of claim 5 wherein said substrate layer is formed of microwave transparent structural stock material.

7. The article of claim 6 wherein said structural stock material is paper or paperboard.

8. The article of claim 7 wherein said stock material is provided on one side of the layer of electroconductive material and a polymeric film is provided on the other.

9. The article of claim 8 formed into a dish.

10. The article of claim 9 wherein said dish is a pot pie dish having a bottom wall and a side wall.

11. The article of claim wherein said plurality of apertures is arranged extending radially from the centre of the bottom wall of the dish and into the side walls of the dish to be engaged by the pot pie when located in the dish.

12. The article of claim 11 in combination with a pot pie located in said dish.

13. The article of claim 11 wherein each of said apertures a has the same width.

14. The article of claim 10 wherein said plurality of apertures comprises an elongate spiral extending from the side wall of the pot pie dish to the centre of the bottom wall.

15. The article of claim 14 in combination with a pot pie located in said dish.

16. The article of claim 8 formed into a bag structure.

17. The article of claim 16 wherein said plurality of apertures comprises a plurality of individual parallel elongate apertures closely spaced one from another.

18. The article of claim 16 in combination with said foodstuff enclosed within said bag structure.

19. The article of claim 7 wherein said structural stock material is provided on both sides of the layer of electroconductive material.

20. The article of claim 19 formed into a bag structure adapted to enclose said foodstuff.

21. The article of claim 20 in combination with said foodstuff enclosed within said bag structure.

22. The article of claim 21 wherein said foodstuff comprises a crusty filled product.

23. The article of claim 21 wherein said foodstuff comprises french fries.

24. The article of claim 5 wherein said layer of electroconductive material is laminated between outer layers of polymeric material.

25. The article of claim 24 wherein at least one of said polymeric material layers is formed of rigid moldable material.

26. The article of claim 25 molded into a tray or dish.

27. The article of claim 26 in combination with said foodstuff located in said tray or dish.

28. The article of claim 1 wherein a further layer of electroconductive material having a thickness sufficiently small as to effect conversion of a portion of incident microwave energy to thermal energy is positioned in engagement with said substrate layer to achieve an augmented heating effect in said plurality of apertures by exposure of said further layer of electroconductive material to microwave energy.

29. The article of claim 1 wherein said microwave transparent layer comprises a polymeric film layer to which said layer of electroconductive material is adhered by laminating adhesive.

30. The article of claim 29 wherein said plurality of elongate apertures in said layer of electroconductive material is formed therein by selective demetallization.

31. The article of claim 30 wherein said layer of electroconductive material is coated with a layer of detackifying material for said laminating adhesive following said selective demetallization.

32. The article of claim 30 wherein a layer of food release material is provided on food-contacting areas of said polymeric film layer on the opposite side thereof from that to which said electroconductive material is adhered.

33. The article of claim 1 in combination with said foodstuff packaged therein with said plurality of apertures located in thermal energy-generating relationship with said foodstuff.

* * * * *